US007814942B2

(12) United States Patent
Larsson

(10) Patent No.: US 7,814,942 B2
(45) Date of Patent: Oct. 19, 2010

(54) VAPOR RECOVERY SYSTEM FOR LOW TEMPERATURES

(75) Inventor: Bengt Larsson, Skivarp (SE)

(73) Assignee: Dresser, Inc., Addison, TX (US)

( * ) Notice: Subject to any disclaimer, the term of this patent is extended or adjusted under 35 U.S.C. 154(b) by 1022 days.

(21) Appl. No.: 11/477,071

(22) Filed: Jun. 28, 2006

(65) Prior Publication Data

US 2007/0107799 A1 May 17, 2007

(30) Foreign Application Priority Data

Jun. 29, 2005 (EP) ..... 05014067

(51) Int. Cl.
*B65B 1/04* (2006.01)

(52) U.S. Cl. ..... 141/290; 141/7; 141/59

(58) Field of Classification Search ..... 141/5, 141/7, 37, 44, 45, 59, 83, 94, 290, 285, 302, 141/392
See application file for complete search history.

(56) References Cited

U.S. PATENT DOCUMENTS

| | | | | |
|---|---|---|---|---|
| 2,831,350 A | | 4/1958 | Banks et al. | |
| 3,802,283 A | | 4/1974 | Bahrton | |
| 5,040,577 A | * | 8/1991 | Pope | 141/59 |
| 5,992,395 A | | 11/1999 | Hartsell, Jr. et al. | |
| 6,179,163 B1 | | 1/2001 | Bohr et al. | |
| 6,290,760 B1 | | 9/2001 | Taivalkoski et al. | |
| 6,325,112 B1 | | 12/2001 | Nanaji | |
| 6,357,493 B1 | * | 3/2002 | Shermer et al. | 141/59 |
| 2004/0163726 A1 | | 8/2004 | Nanaji | |

FOREIGN PATENT DOCUMENTS

| | | | |
|---|---|---|---|
| EP | 0473818 A1 | | 9/1990 |
| EP | 0532202 A2 | | 8/1992 |
| EP | 1460033 | * | 2/2004 |

OTHER PUBLICATIONS

Communication from Swedish Patent Office re EPO application 05106269.3—2209 mailed Jan. 23, 2006 regarding Extended European Search Report results (6 pages).
European Search Report for European Patent Application No. 05014067.2 (3 pages), mailed on Dec. 12, 2005.

* cited by examiner

*Primary Examiner*—Gregory L. Huson
*Assistant Examiner*—Jason K Niesz
(74) *Attorney, Agent, or Firm*—Fish & Richardson P.C.

(57) ABSTRACT

A fuel dispensing apparatus for dispensing fuel to a motor vehicle tank comprises a fuel dispensing means, a vapor recovery system for recovering vapor from the motor vehicle tank, and a monitoring system for monitoring the functioning of the vapor recovery system. The monitoring system is arranged to shut off the fuel dispensing means in case of detection of a malfunction in the vapor recovery system. The monitoring system comprises a temperature sensor. The monitoring system is arranged to, in case the temperature measured by the temperature sensor lies in a predetermined temperature range, ignore any detected malfunction and refrain from shutting off the fuel dispensing means.

36 Claims, 1 Drawing Sheet

VAPOR RECOVERY SYSTEM FOR LOW TEMPERATURES

REFERENCE TO RELATED APPLICATION

The present application claims the benefit of priority under 35 U.S.C. §119 to European Patent Application No. 05014067.2 filed on Jun. 29, 2005.

TECHNICAL FIELD

The present invention relates to fuel dispensing apparatuses and fuel dispensing methods.

BACKGROUND

When filling the fuel tank of a motor vehicle, it is common to recover the vapor escaping the tank when filling it with liquid fuel from a fuel pump unit, this since gasoline and diesel vapors contain hydrocarbons that are harmful to inhale and have negative effects on the environment. The vapor recovery is performed by a system integrated in the fuel pump unit. The system usually comprises a pump for drawing vapor from the tank and vapor measuring means which measures the volume of vapor recovered and compares it with the volume of dispensed fuel. Adjusting means are provided which adjust the flow rate of the vapor to match the flow rate of the fuel. An example of such a system is described in European patent application EP1460033. Such a system normally comprises a number of valves and other components, which should function properly in order for the vapor recovery system to work as it is supposed to. Though not described in EP1460033, a prior art vapor recovery system comprises a monitoring system which is set to shut off the fuel pump in case a failure is detected. The monitoring system comprises a central unit connected to the vapor measuring means, and to sensing means for sensing whether the previously mentioned valves and other components are functioning properly. The monitoring means further comprises some kind of electronic means for shutting off the fuel pump. The means for shutting off the fuel pump shuts off the pump when the central unit determines that the measuring means is detecting an alarmingly small volume of recovered vapor, or when the sensing means detect failure in any of the monitored components. Any of these events is in other words interpreted as a signal that the vapor recovery is not working. However, such monitoring systems are also sensitive to low temperatures. This since the valves and other components which are equipped with sensing means, as well as the sensing means and the ingoing parts of the measuring means, are sensitive to cold. Thus, on a number of occasions, fuel pumps have been known to shut off without due cause, which causes great inconvenience for a customer using the pump, especially in an area where the petrol stations are scarce and the climate is harsh with low temperatures.

SUMMARY

The object of the present invention is to provide a fuel dispensing apparatus and method which functions well in a cold climate. This object is achieved by a fuel dispensing apparatus and method having the features stated in the appended claims. The inventive fuel dispensing apparatus for dispensing fuel to a motor vehicle tank comprises fuel dispensing means, vapor recovery means for recovering vapor from the motor vehicle tank, and a monitoring system for monitoring the functioning of the vapor recovery means, which system is arranged to shut off the fuel dispensing means in case of detection of a malfunction in the vapor recovery system, wherein the monitoring system comprises a temperature sensor and is arranged to, in case the temperature measured by the temperature sensor lies in a predetermined temperature interval, ignore any detected malfunction. According to a preferred embodiment, the monitoring system is arranged to shut off the vapor recovery system in case the temperature lies in the predetermined interval. This has the advantage of providing better reliability of service in a climate where it is known that in a certain temperature interval, the monitoring system is likely to detect failure and at the same time the content of harmful hydrocarbons in the vapor is low. This since when handling liquid fuel in a low temperature environment, the degree of saturation of the vapor that arises from the fuel, and hence the content of hydrocarbons, is much lower than what is the case at a temperature of, say, 15° C. Thus, the vapor recovery system is much less needed at such low temperatures where the monitoring system is likely to detect failures due to the cold, and the fact that a failure is ignored and possibly the vapor recovery system is shut off will not cause any substantial amount of hydrocarbons being let out in the open air. The temperature sensor can be arranged to measure the ambient temperature or the temperature of the vapor. The temperature interval (range) is preferably below about −10° C., which usually is a temperature where the above mentioned sensitivity to cold is noticeable.

The details of one or more embodiments of the invention are set forth in the accompanying drawings and the description below. Other feature, objects, and advantages of the invention will be apparent from the description and drawings, and from the claims.

DESCRIPTION OF DRAWINGS

The present invention will now be described in more detail by way of an embodiment, reference being made to the accompanying drawing, in which.

Like reference symbols in the various drawings indicate like elements.

DETAILED DESCRIPTION

Figure 1:
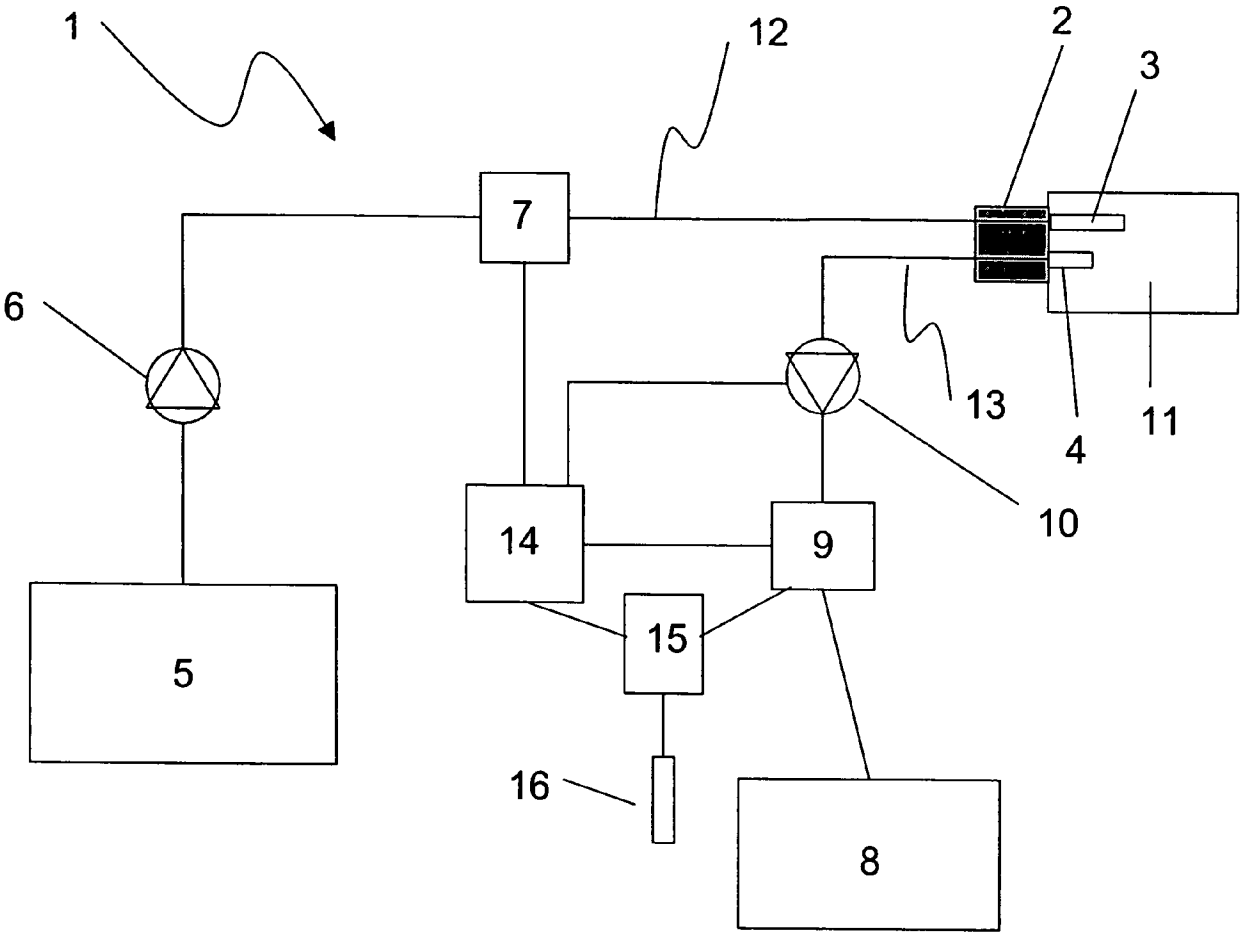
FIG. 1 is a schematic view of a fuel dispensing apparatus according to the invention.

The fuel dispensing apparatus 1 in FIG. 1 comprises a fuel dispensing nozzle 2 with a fuel outlet 3 and a vapor inlet 4. A fuel tank 5, a fuel pump 6 and fuel flow rate measuring means 7 are provided in the fuel dispensing device 1. Further, the fuel dispensing apparatus 1 comprises a vapor tank 8, vapor flow rate measuring means 9, a vapor pump 10, a fuel conduit 12, a vapor conduit 13 and adjusting means 14. A motor vehicle tank 11 is also shown in FIG. 1. Fuel is fed from the fuel tank 5, by means of the fuel pump 6, via the fuel conduit 12 and the fuel outlet 3, to the motor vehicle tank 11. The output from the fuel flow rate measuring means 7 is used to indicate the volume of fuel dispensed to the motor vehicle tank 11 on a display (not shown) on the fuel dispensing device 1 and is further used for calculating the fuel cost for the filling up of the motor vehicle tank 11. When the fuel is fed to the motor vehicle tank 11, vapor is displaced by the fuel. To prevent the vapor from escaping into the ambient air, the vapor is drawn into the vapor inlet 4 by means of the vapor pump 10, via the vapor conduit 13, into the vapor tank 8. It is possible that the vapor tank 8 and the fuel tank 5 is the same tank, i.e. that the vapor is recovered to the fuel tank 5 instead of to a separate vapor tank 8. The volume of vapor recovered from the motor vehicle tank 11 is determined by the vapor flow rate measuring means 9. The adjusting means 14 are arranged to adjust the vapor pump 10 so that a desired volume of vapor is recovered from the motor vehicle tank 11. The vapor flow rate measured by the vapor flow rate measuring means 9, as well as the functioning of any valve or other component involved in the vapor recovery is monitored by a monitoring system, which is schematically shown in FIG. 1.

The monitoring system comprises a central unit 15 connected to the vapor flow rate measuring means 9, and to sensing means (not shown) for sensing whether the previously mentioned valves and other components are functioning properly. The monitoring system further comprises some kind of electronic means (not shown) for shutting off the fuel pump. When the central unit 15 receives a vapor flow rate from the vapor flow rate measuring means 9 which is alarmingly low, or if the central unit 15 receives a signal from any of the sensing means that a component is not working, it is, according to prior art, set to activate the means for shutting off the fuel pump, and stop the dispensing of fuel to the motor vehicle tank by shutting off the fuel pump. Normally a signal is also sent to a service operator that the monitoring system has detected a failure and that the fuel pump has been shut off. Until the service operator has checked and fixed the failure, the fuel dispensing apparatus cannot be used. If the fuel dispensing apparatus is situated in a place where the climate is harsh with low temperatures below, say, −10° C., the probability for detection of a failure rises quite dramatically due to the fact that the valves and other components which are equipped with sensing means, as well as the sensing means themselves, and the parts of the measuring means, are sensitive to cold. The central unit can also be sensitive to cold.

The monitoring system according to the invention is connected to a temperature sensor 16, which in FIG. 1 is shown schematically and connected to the central unit 15. The temperature sensor 16 can, for instance, be located in the fuel conduit 12 for measuring the temperature of the fuel, in the vapor conduit 13 for measuring the temperature of the vapor, or on the outside of the fuel dispensing apparatus for measuring the ambient temperature.

In the present fuel dispensing apparatus, the monitoring system receives a measured temperature from the temperature sensor 16. If the temperature measured at the time when the failure is detected is in a certain interval, i.e. below −10° C., the monitoring system is arranged to not shut off the fuel pump, i.e. stop the dispensing of fuel, but instead to either ignore the detected failure, or shut off the vapor recovery system. When handling liquid fuel in a low temperature environment, the degree of saturation of the vapor that arises from the fuel, and hence the content of hydrocarbons, is much lower than what is the case at a temperature of, say, 15° C. Thus, the vapor recovery system is much less needed at such low temperatures where the monitoring system is likely to detect failures due to the cold, and the fact that a failure is ignored and possibly the vapor recovery system is shut off is not likely to cause any substantial amount of hydrocarbons being let out in the open air.

As an alternative to the above, the monitoring system can also be set to shut off the vapor recovery system at all times when the temperature is below a predetermined temperature, for instance −10° C., i.e. not only when a failure is detected. According to one embodiment, the vapor flow rate measuring means is a meter of the swing jet type, also known as a fluidistor. The function and structure of such a meter is well known to the skilled person. A fluidistor for vapor flow rate measuring purposes comprises a temperature sensor located in a measuring conduit which in both ends is connected to a main conduit through which the vapor flows. The vapor flowing through the main conduit in the meter creates a spontaneous oscillation in the measuring conduit, which in turn affects the temperature of a temperature sensor in an oscillating manner. The frequency of the temperature oscillation is proportional to the vapor flow rate. According to the embodiment, the temperature sensor in the fluidistor constitutes the temperature sensor in the monitoring system.

A number of embodiments of the invention have been described. Nevertheless, it will be understood that various modifications may be made without departing from the spirit and scope of the invention.

What is claimed is:

1. A fuel dispensing apparatus for dispensing fuel to a motor vehicle tank, comprising a fuel dispensing means, a vapor recovery system for recovering vapor from the motor vehicle tank, and a monitoring system adapted to monitor the functioning of the vapor recovery system, which monitoring system is arranged to shut off the fuel dispensing means in case of detection of a malfunction in the vapor recovery system, wherein the monitoring system comprises a temperature sensor arranged to measure a temperature and a central control unit, the central control unit programmed to ignore the detected malfunction and continue to dispense fuel to the motor vehicle tank by the fuel dispensing means based on the measured temperature being within a predetermined range, the central control unit monitoring system further programmed to shut off the fuel dispensing means so that fuel is stopped from being dispensed to the motor vehicle tank in response to the detected malfunction, based on the measured temperature being outside of the predetermined range.

2. A fuel dispensing apparatus according to claim 1, wherein the monitoring system is arranged to shut off the vapor recovery system in case the measured temperature lies in the predetermined temperature range.

3. A fuel dispensing apparatus according to claim 1, wherein the temperature sensor is arranged to measure the temperature of the vapor.

4. A fuel dispensing apparatus according to claim 2, wherein the temperature sensor is arranged to measure the temperature of the vapor.

5. A fuel dispensing apparatus according to claim 1, wherein the temperature sensor is arranged to measure the ambient temperature.

6. A fuel dispensing apparatus according to claim 2, wherein the temperature sensor is arranged to measure the ambient temperature.

7. A fuel dispensing apparatus according to claim 1, wherein the predetermined temperature range is below about −10° C.

8. A fuel dispensing apparatus according to claim 2, wherein the predetermined temperature range is below about −10° C.

9. A fuel dispensing apparatus according to claim 3, wherein the predetermined temperature range is below about −10° C.

10. A fuel dispensing apparatus according to claim 4, wherein the predetermined temperature range is below about −10° C.

11. A fuel dispensing apparatus according to claim 5, wherein the predetermined temperature range is below about −10° C.

12. A fuel dispensing apparatus according to claim 6, wherein the predetermined temperature range is below about −10° C.

13. A fuel dispensing apparatus according to claim 7, wherein the predetermined temperature range is below about −10° C.

14. A fuel dispensing apparatus according to claim 1, wherein the temperature sensor is part of a vapor measuring means, which in turn is part of the vapor recovery system, which measuring means is in the form of a fluidistor.

15. A fuel dispensing apparatus according to claim 2, wherein the temperature sensor is part of a vapor measuring means, which in turn is part of the vapor recovery system, which measuring means is in the form of a fluidistor.

16. A fuel dispensing apparatus according to claim 3, wherein the temperature sensor is part of a vapor measuring means, which in turn is part of the vapor recovery system, which measuring means is in the form of a fluidistor.

17. A fuel dispensing apparatus according to claim 4, wherein the temperature sensor is part of a vapor measuring means, which in turn is part of the vapor recovery system, which measuring means is in the form of a fluidistor.

18. A fuel dispensing apparatus according to claim 5, wherein the temperature sensor is part of a vapor measuring means, which in turn is part of the vapor recovery system, which measuring means is in the form of a fluidistor.

19. A fuel dispensing apparatus according to claim 6, wherein the temperature sensor is part of a vapor measuring means, which in turn is part of the vapor recovery system, which measuring means is in the form of a fluidistor.

20. A fuel dispensing apparatus according to claim 7, wherein the temperature sensor is part of a vapor measuring means, which in turn is part of the vapor recovery system, which measuring means is in the form of a fluidistor.

21. A fuel dispensing apparatus according to claim 8, wherein the temperature sensor is part of a vapor measuring means, which in turn is part of the vapor recovery system, which measuring means is in the form of a fluidistor.

22. A fuel dispensing apparatus according to claim 9, wherein the temperature sensor is part of a vapor measuring means, which in turn is part of the vapor recovery system, which measuring means is in the form of a fluidistor.

23. A fuel dispensing apparatus according to claim 10, wherein the temperature sensor is part of a vapor measuring means, which in turn is part of the vapor recovery system, which measuring means is in the form of a fluidistor.

24. A fuel dispensing apparatus according to claim 11, wherein the temperature sensor is part of a vapor measuring means, which in turn is part of the vapor recovery system, which measuring means is in the form of a fluidistor.

25. A fuel dispensing apparatus according to claim 12, wherein the temperature sensor is part of a vapor measuring means, which in turn is part of the vapor recovery system, which measuring means is in the form of a fluidistor.

26. A fuel dispensing apparatus according to claim 13, wherein the temperature sensor is part of a vapor measuring means, which in turn is part of the vapor recovery system, which measuring means is in the form of a fluidistor.

27. A fuel dispensing method, comprising the steps of dispensing fuel to a motor vehicle tank by a fuel dispensing means, recovering vapor from the motor vehicle tank by a vapor recovery system, monitoring the functioning of the vapor recovery system by a monitoring system, detecting, by the monitoring system, a malfunction in the vapor recovery system, measuring a temperature, based on the measured temperature being within a predetermined range, ignoring the detected malfunction and continuing to dispense fuel to the motor vehicle tank by the fuel dispensing means, and based on the measured temperature being outside of the predetermined range, responding to the detected malfunction by shutting off the fuel dispensing means so that fuel is stopped from being dispensed to the motor vehicle tank.

28. A fuel dispensing method according to claim 27, further comprising the step of, based on the measured temperature being within the predetermined range, shutting off the vapor recovery system.

29. A fuel dispensing method according to claim 27, wherein the measured temperature is the temperature of the fuel.

30. A fuel dispensing method according to claim 28, wherein the measured temperature is the temperature of the fuel.

31. A fuel dispensing method according to claim 27, wherein the measured temperature is the ambient temperature.

32. A fuel dispensing method according to claim 28, wherein the measured temperature is the ambient temperature.

33. A fuel dispensing method according to claim 27, wherein the predetermined temperature range is below about −10° C.

34. A fuel dispensing method according to claim 28, wherein the predetermined temperature range is below about −10° C.

35. A fuel dispensing method according to claim 29, wherein the predetermined temperature range is below about −10° C.

36. A fuel dispensing method according to claim 30, wherein the predetermined temperature range is below about −10° C.

* * * * *

UNITED STATES PATENT AND TRADEMARK OFFICE

CERTIFICATE OF CORRECTION

PATENT NO. : 7,814,942 B2
APPLICATION NO. : 11/477071
DATED : October 19, 2010
INVENTOR(S) : Bengt Larsson It is certified that error appears in the above-identified patent and that said Letters Patent is hereby corrected as shown below:

IN THE CLAIMS:

In Column 4, Claim 1, line 17, delete "monitoring system".

Signed and Sealed this

Twenty-first Day of December, 2010

David J. Kappos

David J. Kappos
*Director of the United States Patent and Trademark Office*